US006894709B2

(12) United States Patent
Pferrer

(10) Patent No.: US 6,894,709 B2
(45) Date of Patent: May 17, 2005

(54) DEVICE AND METHOD FOR LABELING OBJECTS

(75) Inventor: Markus Pferrer, Dormagen (DE)

(73) Assignee: Espera-Werke GmbH, Duisburg (DE)

( * ) Notice: Subject to any disclaimer, the term of this patent is extended or adjusted under 35 U.S.C. 154(b) by 0 days.

(21) Appl. No.: 10/493,566

(22) PCT Filed: Jun. 3, 2003

(86) PCT No.: PCT/EP03/05770

§ 371 (c)(1),
(2), (4) Date: Sep. 23, 2004

(87) PCT Pub. No.: WO2004/018216

PCT Pub. Date: Mar. 4, 2004

(65) Prior Publication Data

US 2005/0017995 A1 Jan. 27, 2005

(30) Foreign Application Priority Data

Aug. 23, 2002 (DE) ..... 102 39 630

(51) Int. Cl.[7] ..... B41J 2/32
(52) U.S. Cl. ..... 347/171
(58) Field of Search ..... 347/171, 197, 347/218, 91; 400/120.16, 202.2; 177/5

(56) References Cited

U.S. PATENT DOCUMENTS 4,415,048 A 11/1983 Teraoka ..... 177/5
4,422,376 A 12/1983 Teraoka ..... 101/69
4,544,287 A 10/1985 Teraoka ..... 400/120.16
4,630,067 A * 12/1986 Teraoka ..... 347/180
4,725,860 A 2/1988 Kohyama et al. ..... 347/91

* cited by examiner

*Primary Examiner*—K. Feggins
(74) *Attorney, Agent, or Firm*—Proskauer Rose LLP

(57) ABSTRACT

The invention relates to a device and a method for labelling objects, in particular food packages. The device comprises a printer, in particular a thermal-direct printer or thermal-transfer printer for printing labels; an application device for applying a printed label to the object to be labelled; and at least one working device, arranged upstream of the application device, in the form of a weighing device, a packaging device, and/or a transport device for the objects to be labelled. In order to prolong the service life of the print head and to improve the print quality, the provision of a measuring and control device is proposed which for each object to be labelled determines the printing time that is available for printing the label to be applied to each of said objects, taking into account the required working time of the working device/s, and which measuring and control device, depending on the printing time determined, controls the printer such that printing of the label is completed within the available printing time at a matching printing speed, which is as slow as possible.

13 Claims, 3 Drawing Sheets

DEVICE AND METHOD FOR LABELING OBJECTS

BACKGROUND OR THE INVENTION

The present device relates to a device for labelling objects, comprising a printer for printing labels, an application device for applying a printed label to the respective object to be labelled, and at least one working device in the form of a weighing device, a packaging device and/or a transport device for the objects to be labelled, wherein the working device, of which there is at least one, is arranged upstream of the application device. Furthermore, the invention relates to a method for labelling objects, comprising the following steps: printing a label by means of a printer; applying the printed label to the object to be labelled; and at least one more process step, which takes place upstream of the application of the printed label. The printer used can in particular be a thermal-direct printer or thermal-transfer printer.

Devices and methods of the type mentioned in the introduction have been known for some considerable time (see e.g. U.S. Pat. No. 4,415,048).

Depending on its design, the print head of a generic device is subject to some degree of wear. This wear has its origins in the slightly abrasive effect of the labels during the printing time.

SUMMARY OF THE INVENTION

It is thus the object of the present invention to modify a device and a method of the type mentioned in the introduction to the extent that while the highest possible throughput is achieved, the service life, in particular of a thermal printer strip, is extended when compared to that of the state of the art, and furthermore that the best print quality for the respective throughput performance is achieved.

With regard to the device, according to the invention this object is met in that a measuring and control device is used which for each object to be labelled determines the printing time that is available for printing the label to be applied to each of said objects, taking into account the required working time of the working device/s which is/are arranged upstream of the application device, and which, depending on the printing time determined, controls the printer such that printing of the label is completed within the available printing time at a matching printing speed, which is as slow as possible.

With regard to the method, according to the invention the object is met in that for each object to be labelled a calculation takes place of the printing time available for printing the label to be applied to said object, taking into account the working time required for the process step, of which there is at least one, which process step takes place upstream of the point where the printed label is applied, and in that, depending on the printing time calculated, printing of the label is controlled such that printing of the label is completed within the available printing time at a matching printing speed, which is as slow as possible.

When compared to conventional devices of the type discussed herein, in which the labels to be applied are printed at a relatively slow, constant printing time, the invention thus proposes that in respect to each individual label to be printed the work be carried out with a printing time which is matched to the timing of the device. Without reducing the throughput performance of a generic device, according to the invention the time available for printing is utilised to the full extent so that the printing speed during printing of a label can be selected to be as slow as possible, in this way being as gentle as possible on a thermal print head. Printing time is determined by the time-dependent behaviour of the devices arranged upstream and downstream. The maximum permissible printing time thus depends on the combination of the working time or working speed of the weighing device, the packaging device and the transport device which are arranged upstream; as well as on the application device, arranged downstream; and/or on other working devices arranged upstream or downstream.

A preferred embodiment of the invention consists in that the at least one working device, which is arranged upstream of the application device, comprises at least one sensor which registers the arrival, in the working device, of an object to be labelled, and issues a corresponding signal to the measuring and control device, after which said measuring and control device determines the printing time which is available for printing the label to be applied to the object, taking into account the time required by the application device for applying a label.

A further preferred embodiment of the invention consists of the measuring and control device comprising a processor which on the basis of the working speed of the working device, of which there is at least one, and on the basis of the time required for applying a label, calculates the printing time which is available for printing the label to be applied to the object.

Furthermore, in an advantageous embodiment of the invention, along a transport path for the objects to be labelled, several sensors are arranged, spaced apart from each other in the direction of transport, with said sensors registering the arrival of the object to be labelled, and issuing a corresponding signal to the measuring and control device. This embodiment makes it possible, when the respective signal is received, to determine a remaining residual printing time, and to control printing of a label, depending on the determined residual printing time, such that printing of the label is completed within the still available residual printing time at a matching printing speed, which is as slow as possible. This embodiment makes it possible, in particular, to recalculate an already calculated profile for time-dependent control of the printing speed during a printing process, and in this way to reduce the printing speed in the case of any delays which have occurred in one of the working devices arranged upstream of the application device so that, during the still available residual printing time, printing can take place at the respective minimum printing speed. In this way, the service life of a thermal printer strip can be further prolonged.

Further preferred and advantageous embodiments of the invention are disclosed in the subordinate claims.

BRIEF DESCRIPTION OF THE DRAWINGS

Below, the invention is explained in more detail with reference to a drawing which shows one embodiment.

DETAILED DESCRIPTION OF THE INVENTION

Figure 1:
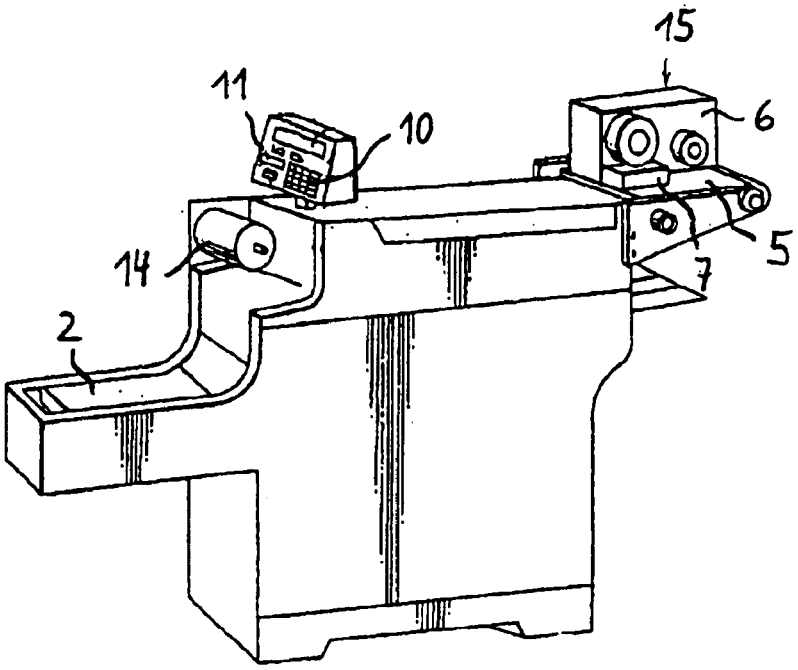
FIG. 1 shows a perspective view of a device according to the invention.
Figure 2:
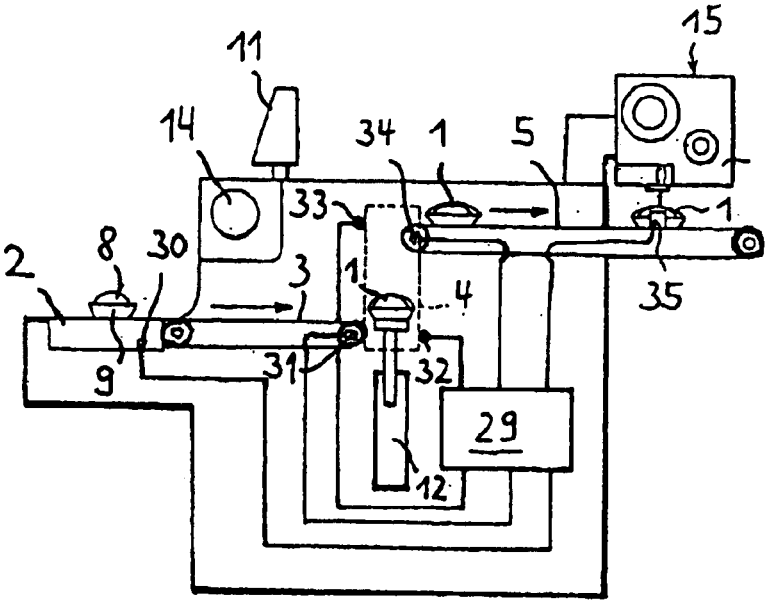
FIG. 2 is a vertical section view of the device according to FIG. 1, which diagrammatically shows the operation of said device.
Figure 3:
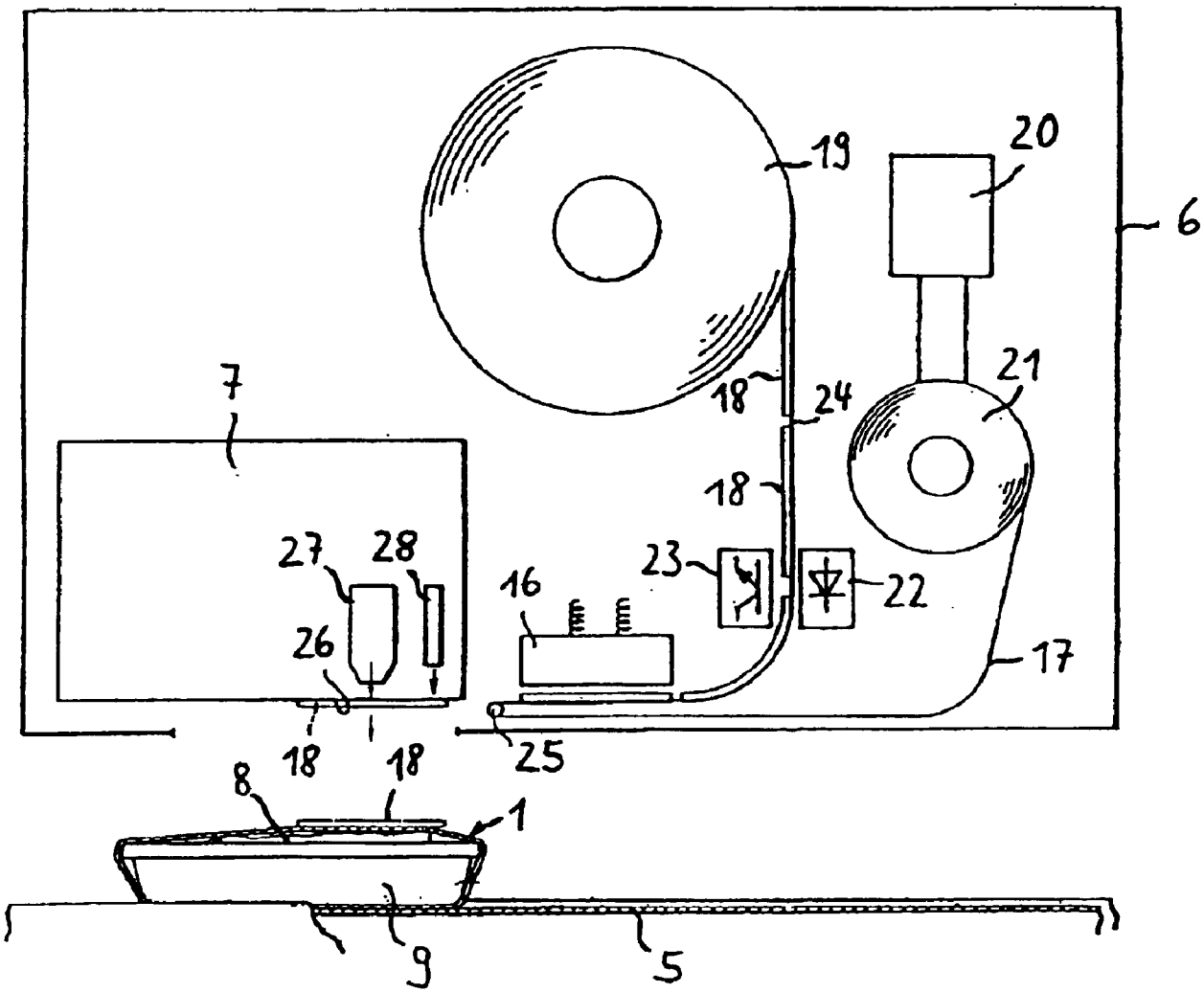
FIG. 3 shows a vertical section view of a label-printing unit and labelling unit of the device according to FIG. 1.

FIGS. 1 to 3 of the drawing show a device for labelling foodstuffs packages 1. The device comprises several working devices, namely a weighing device 2; a first transport device 3 in the form of a belt conveyor; a packaging device 4; a second transport device 5, also in the form of a belt conveyor; a printer 6 for printing labels; and an application device 7 for applying a printed label to a packaged foodstuffs package 1.

Foodstuffs portions 8 are placed into a package tray 9 and together with the tray 9 are arranged on the weighing device 2. By way of a keyboard 10, the tare weight of the package trays 9, the name of the foodstuff, the price per unit of weight, as well as other goods-specific data can be entered into a memory of an input and display unit 11. Said input and display unit 11 comprises a processor which, from the weight of the foodstuffs portion that has been determined by the weighing device 2 and the price per unit of weight, calculates the sales price of the respective foodstuffs portion.

On completion of the calculation of the sales price, the tray 9 with the foodstuffs portion 8 is transferred to the first belt conveyor 3. To this effect, for example a pusher device (not shown) can be arranged at the weighing device 2.

By way of the belt conveyor 3, the tray 9 with the foodstuffs portion 8 reaches the packaging device 4, which comprises a lifting device 12, a film wrapping mechanism (not shown) as well as a heating device (not shown), for example an infrared radiator. In the packaging device 4, the tray 9 with the foodstuffs portion 8 is wrapped with a transparent shrink film, and subsequently the film is shrunk by means of the heating device. The film is unrolled from a supply reel 14.

During the packaging process, the tray 9 is lifted by means of the lifting device 12, and after completion of the packaging process is transferred to the second belt conveyor 5 which transports the food package 1 to the unit 15 which comprises the label printer 6 as well as the label application device 7.

The label printer 6 comprises a thermal strip within the thermal print head 16, with labels 18 adhering to a strip of carrier tape 17 being supplied to said thermal print head 16 from a label supply reel 19 (compare FIG. 3). To this effect, the strip of carrier tape 17 is wound onto a reel 21 driven by an electric motor 20. The self-adhesive labels 18 have been attached to the strip of carrier tape 17 with equal distance between said labels. Associated with the strip of carrier tape 17 made of translucent material is an optical sensor device which comprises a light-emitting transmitter diode 22 and a receiver diode 23 and which is thus able to detect sections 24 on the strip of carrier tape 17 which do not contain any labels. The signals emitted by the receiver diode 23 are used for controlling the motor 20 which is associated with the take-up reel 21.

The thermal strip within the thermal print head 16 of the label printer 6 comprises print elements, arranged side-by-side, which are e.g. flat resistors (small heating plates) which can be controlled individually, i.e. independently of each other, and which quickly heat up and cool down. The relatively long cooling time of the resistors limits the possible printing speed. The labels 18 are made from heat-sensitive special paper. As an alternative to this, the label printer 6 can comprise a heat-sensitive thermal-transfer printer ribbon (not shown). In this case, it is possible to print onto labels made from ordinary paper.

When viewed in the direction of transport of the strip of carrier tape 17, behind the print head 16 there is a relatively strong deflection 25, at which the printed labels 18, which adhere to the strip of carrier tape 17, peel off said strip of carrier tape 17 and are transferred to the application device 7. In the embodiment shown, the application device comprises a perforated suction area 26 at its underside, through which suction area 26 air is drawn in by means of an extractor fan (not shown) so that a printed label 18 is held to the suction area 26. Furthermore, the application device comprises an air jet nozzle 27 with which for a period of time an air jet can be generated whose pressure exceeds the amount of the negative pressure existing at the suction area 26. A label which is held at the suction area 26 can thus be released from the suction area 26 by means of this temporary generation of an air jet, and can be applied to a food package 1 which is situated below. 28 designates a label sensor which detects the presence of a label 18 at the suction area 26. The time required by the application device 7 for applying a label 18 is approximately the same for each label.

In FIG. 2, a diagrammatically shown measuring and control device is designated 29. Connected to the measuring and control device 29, which comprises a processor as well as a memory, are several sensors 30–35, by means of which the working speed and thus the working time of the weighing device 2, the transport device 3, the packaging device 4 as well as the transport device 5 can be registered. The working time of the weighing device 2 corresponds to the time which passes from the point in time a package tray 9 with a foodstuffs portion 8 arranged thereon is placed on said weighing device 2, to the point in time at which the weighing signal has stabilised, which includes transmission of the stabilised weighing signal to the processor of the input and display unit 11. The working time of the transport device 3 corresponds to the time which passes from the point in time at which the package tray 9 with the foodstuffs portion 8 is conveyed to the transport device 3 to the point in time at which the package tray 9 with the foodstuffs portion 8 is transferred to the packaging device 4. When a belt conveyor is used as a transport device 3, the working time of the transport device can be determined in particular on the basis of the belt speed or the rotary speed of the belt drive roller or of the deflection roller in conjunction with the known length of the conveying distance. The working time of the packaging device 4 corresponds to the time which passes from the point in time of transfer of the package tray 9 with the foodstuffs portion 8 to the packaging device 4 to the point in time at which the packaged foodstuffs portion is transferred to the transport device 5. The beginning and end of this time interval can for example be registered by means of photoelectric barriers 32, 33 which are arranged at the transfer points between the transport device 3 and the packaging device 4, and between the packaging device 4 and the transport device 5, respectively. The working time of the transport device 5 corresponds to the time which passes from the point in time at which the packaged foodstuffs portion 8 is transferred to the second transport device 5 to the point in time at which the packaged foodstuffs portion reaches the application device 7. As an alternative or in addition, the transport devices 3, 5 at the respective transfer points can comprise sensors, e.g. light barriers which register the arrival or transfer of the respective tray 9 or food package 1 and which issue a corresponding signal to the measuring and control device 29.

Expediently, the measuring and control device 29 comprises a measuring device (not shown) which registers whether the application device 7 is in its starting position (reset position) and is thus ready for applying a label 18. This measuring device can for example utilise the label sensor 28.

By means of the signals issued by the sensors 30 to 35, and taking into account the time required by the application device 7 for applying a label, the measuring and control device 29 calculates for each package 1 and thus for each label 18 to be applied, the printing time which is available at maximum for printing the label at the highest possible throughput performance of the device (plant). In order to achieve the best possible throughput performance, preferably at least two elements in the operating chain which comprises the weighing device 2, the transport device 3, the packaging device 4, and the transport device 5, can be operated concurrently so that at least two process steps, for example weighing and packaging, can be carried out in parallel. However, it is in particular also possible for all process steps in the chain to be carried out parallel to each other. The maximum time available for printing a label basically depends on the working time which is required by the slowest element in the chain.

While maintaining a highest possible throughput performance of the device, the measuring and control device 29 controls the label printer 6 depending on the calculated maximum available printing time, so that completion of printing of the respective label 18 within the available printing time is at a matching printing speed, which is as slow as possible. To this effect, the measuring and control device 29 generates a time-dependent control profile, for each food package or each label, for controlling the printing speed of the printer 6 with which printing of the label 18 to be applied to the package 1 can be completed within the respectively available printing time at the slowest possible printing speed, without reducing the maximum possible throughput performance of the device.

Figure 4:
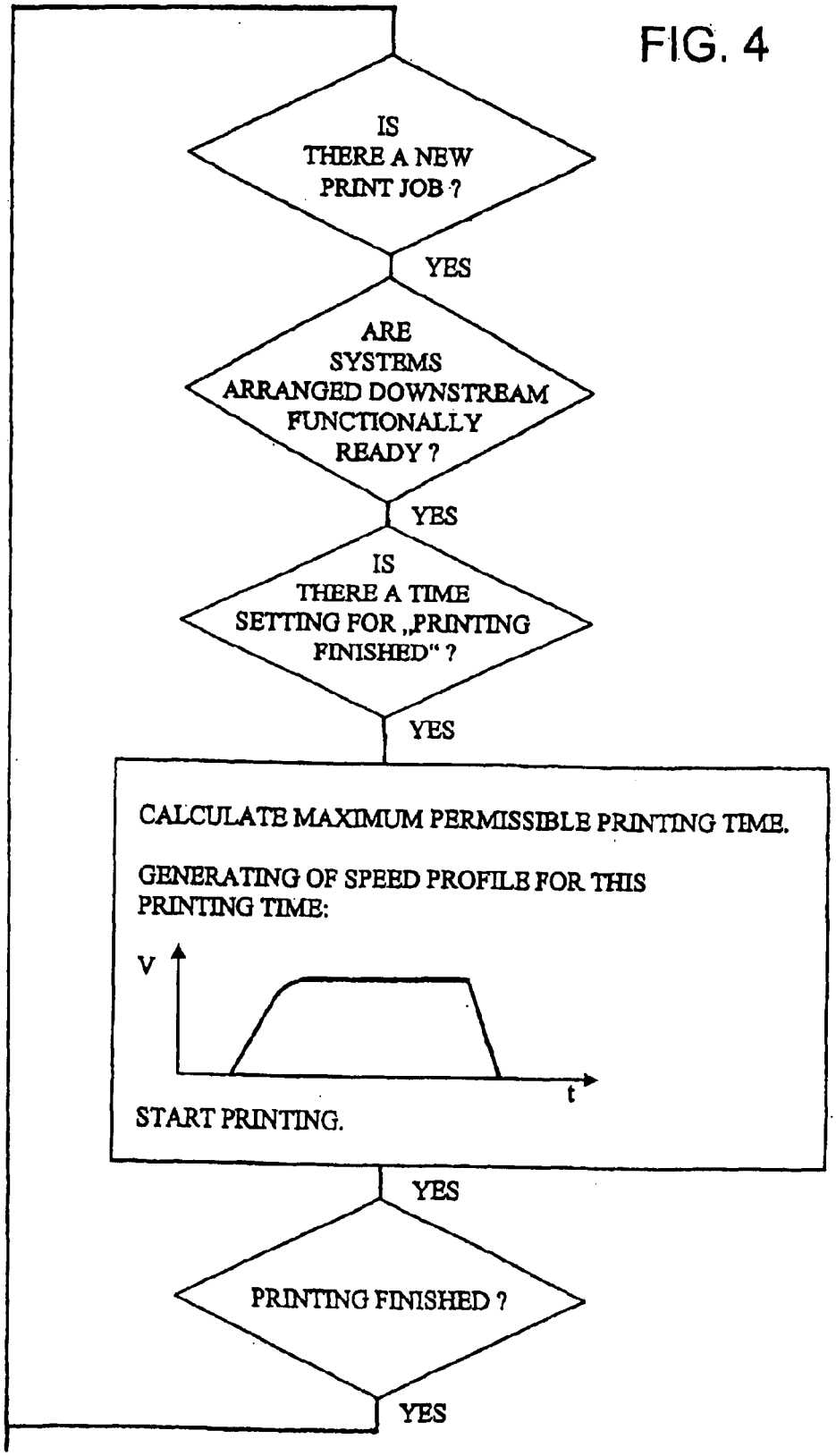
FIG. 4 shows a flow chart for explaining the method according to the invention.

Below, the basic process of the method according to the invention is explained again, with reference to FIG. 4 which shows logical dependencies during the method-related process.

In a device according to the invention, first of all a check is made whether a new print job is present. A new print job is, for example, present if a new package has been weighed and the weight data and price data have been generated. Subsequently, a check is made whether the systems arranged downstream of the label printer are ready for operation. This is, for example, the case if the preceding label has been applied to the associated package, and the application device is back in its starting position, in which it can take up a new printed label. After this, a check is made whether there is an allowed time for the point in time at which printing of the new label has to be completed. This time setting can, for example, be defined by the point in time at which application is to be made, with said point in time at which application is to be made being able to be calculated on the basis of the transport speed, the required position of the label on the package, as well as on other factors. When this time setting (time specification) is present, the maximum permissible printing time is calculated, and in relation to said printing time a time-dependent speed profile or control profile with all speed-dependent parameters is generated, with said profile causing printing of the respective label to be completed within the required time at the slowest possible printing speed. When the respective speed profile or control profile has been generated, printing starts and printing of the respective label is finished by the required point in time. Finally, a check is to be made whether printing has been completed and is thus finished. If this is the case, the next print job can be carried out analogously.

Implementation of the invention is not limited to the embodiment described above. Instead, a multitude of variants are imaginable which make use of the inventive step as defined in the enclosed claims, even if the design is basically different. In particular, the invention is not limited to the labelling of food packages. The invention can also be applied to the labelling of other goods packages.

What is claimed is:

1. A device for labeling objects, in particular food packages, comprising a printer for printing labels; an application device for applying a printed label to the object to be labeled; and at least one working device in the form of a weighing device, a packaging device, or a transport device for the objects to be labeled; wherein the working device, of which there is at least one, is arranged upstream of the application device, characterized by a measuring and control device which for each object to be labeled determines the printing time that is available for printing the label to be applied to each of said objects, taking into account the required working time of the working device/s, and which, depending on the printing time determined, controls the printer such that printing the label is completed within the available printing time at a matching printing speed, which is as slow as possible.

2. The device according to claim 1, wherein the working device, of which there is at least one, comprises at least one sensor which registers the arrival, in the working device, of an object to be labeled, and issues a corresponding signal to the measuring and control device, after which said measuring and control device determines the printing time which is available for printing the label to be applied to the object, taking into account the time required by the application device for applying a label.

3. The device according to claim 1 wherein the measuring and control device comprises a processor which on the basis of the working speed of the working device, of which there is at least one, and on the basis of the time required for applying a label, calculates the printing time which is available for printing the label to be applied to the object.

4. The device according to claim 1, wherein the measuring and control device comprises a device which registers the readiness of the application device for applying a label.

5. The device according to claim 1, wherein the measuring and control device generates a time-dependent control profile, for each object to be labeled, for controlling the printing speed of the printer with which printing of the label to be applied to the object can be completed within the respective printing time at the slowest possible printing speed.

6. The device according to claim 1, wherein along a transport path for the respective object to be labeled, several sensors are arranged, spaced apart from each other in the direction of transport, with said sensors registering the arrival of the object to be labeled.

7. A method for labeling objects, in particular food packages, comprising the following steps: printing a label by means of a printer; applying the printed label to the object to be labeled; and at least one more process step, such as weighing, packaging or transporting the object to be labeled, which process step takes place upstream of the application of the printed label, wherein for each object to be labeled, a calculation takes place of the printing time available for printing the label to be applied to said object, taking into account the working time required for the process step, of which there is at least one, which process step takes place upstream of the application of the printed label, and in that, depending on the printing time calculated, printing of the label is controlled such that printing of said label is completed within the available printing time at a matching printing speed, which is as slow as possible.

8. The method according to claim 7, wherein a process for calculating the printing time available for printing a label is initiated by registering a print job for printing a label to be applied.

9. The method according to claim 8, wherein the print job is automatically generated after completion of a weighing process or after inputting weight data, price data or other goods-related data.

10. The method according to claim 7, wherein calculation of the printing time available for printing a label is made dependent on the detection as to whether an application device arranged downstream of the printer for applying the printed label or other systems which are arranged downstream of the printer are functionally ready.

11. The method according to claim 7, wherein the time available for printing the respective label is calculated on the basis of the working time(s) or work speed(s) of a weighing device, packaging device or transport device, arranged upstream, or on the basis of the working time(s) or work speed(s) of an application device, arranged downstream, for applying the printed label.

12. The method according to claim 7, wherein for each object to be labeled, a time-dependent control profile for controlling the printing speed is generated with which printing of the label to be applied can be completed within the available printing time at a printing speed which is as slow as possible.

13. The method according to claim 7, in which the objects to be labeled are supplied by a transport device to a device for applying a printed label, wherein the transport device defines a transport distance, wherein the arrival of an object to be labeled is recorded in various subsequent positions along the transport distance by means of sensor devices, and a corresponding signal is issued by the respective sensor device to a measuring and control device, wherein upon receipt of the corresponding signal a residual printing time is determined, and printing of the label, depending on the residual printing time determined, is controlled such that printing of the label is completed within the still available residual printing time at a matching printing speed, which is as slow as possible.

* * * * *